US007683833B2

(12) United States Patent
Floyd et al.

(10) Patent No.: US 7,683,833 B2
(45) **Date of Patent: *Mar. 23, 2010**

(54) PHASE SHIFTING AND COMBINING ARCHITECTURE FOR PHASED ARRAYS

(75) Inventors: Brian Allan Floyd, Mahopac, NY (US); Arun Sridhar Natarajan, Pasadena, CA (US)

(73) Assignee: International Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/923,152

(22) Filed: Oct. 24, 2007

(65) Prior Publication Data

US 2008/0180324 A1 Jul. 31, 2008

Related U.S. Application Data

(63) Continuation of application No. 11/619,019, filed on Jan. 2, 2007, now Pat. No. 7,352,325.

(51) Int. Cl.
*H01Q 3/00* (2006.01)

(52) U.S. Cl. ..... 342/372

(58) Field of Classification Search ..... 342/368, 342/372, 373, 374; 607/101, 102
See application file for complete search history.

(56) References Cited

U.S. PATENT DOCUMENTS

| | | | | |
|---|---|---|---|---|
| 3,509,577 | A | 4/1970 | Kinsay | |
| 3,906,502 | A | 9/1975 | Connolly | |
| 4,213,133 | A | 7/1980 | Hidaka | |
| 5,014,023 | A | 5/1991 | Mantele | |
| 5,032,805 | A | 7/1991 | Elmer et al. | |
| 5,079,557 | A | 1/1992 | Hopwood et al. | |
| 5,760,661 | A | 6/1998 | Cohn | |
| 5,940,030 | A | 8/1999 | Hampel et al. | |
| 6,097,267 | A | 8/2000 | Hampel | |
| 6,321,076 | B1 | 11/2001 | Jianqin | |
| 6,538,603 | B1 | 3/2003 | Chen et al. | |
| 6,741,207 | B1 | 5/2004 | Allison et al. | |
| 6,864,837 | B2 * | 3/2005 | Runyon et al. | 342/372 |
| 7,154,440 | B2 * | 12/2006 | Toncich et al. | 342/372 |
| 7,352,325 | B1 * | 4/2008 | Floyd et al. | 342/372 |
| 2003/0069619 | A1 | 4/2003 | Fenn et al. | |

FOREIGN PATENT DOCUMENTS

WO PCT/US07/88928 5/2008

* cited by examiner

*Primary Examiner*—Dao L Phan
(74) *Attorney, Agent, or Firm*—Anne V. Dougherty; Ryan, Mason & Lewis, LLP

(57) ABSTRACT

Improved phased array techniques and architectures are provided. For example, a linear phased array includes N discrete phase shifters and N−1 variable phase shifters, wherein the N−1 variable phase shifters are respectively coupled between adjacent output nodes of the N discrete phase shifters such that the N discrete phase shifters reduce an amount of continuous phase shift provided by the N−1 variable phase shifters. Each of the N discrete phase shifters may select between two or more discrete phase shifts. The N discrete phase shifters also preferably eliminate a need for a variable termination impedance in the linear phased array.

18 Claims, 8 Drawing Sheets

100

200

PHASE SHIFTING AND COMBINING ARCHITECTURE FOR PHASED ARRAYS

CROSS-REFERENCE TO RELATED APPLICATION(S)

This application is a continuation of U.S. application Ser. No. 11/619,019 filed on Jan. 2, 2007, the disclosure of which is incorporated herein by reference.

STATEMENT OF GOVERNMENT RIGHTS

This invention was made with Government support under Contract No.: N66001-02-C-8014 awarded by the Defense Advanced Research Projects Agency. The Government has certain rights in this invention.

FIELD OF THE INVENTION

The present invention generally relates to signal transmitting and receiving systems and, more particularly, to phased arrays used in such systems.

BACKGROUND OF THE INVENTION

A brief overview of phased arrays is provided in this section in a context which illustrates system requirements and existing implementations. In this section, we will focus primarily on the receiver, though the concepts described also can be applied to the transmitter.

Phased arrays are used to electronically steer the direction of maximum sensitivity of a receiver, providing spatial selectivity or equivalently higher antenna gain. Phased arrays find use in many different wireless applications, including but not limited to RADAR and data communications. Beam steering is achieved by first shifting the phase of each received signal by progressive amounts to compensate for the successive differences amongst arrival phases. These signals are then combined, where the signals add constructively for the desired direction and destructively for other directions.

FIG. 1 shows a block diagram of a conventional linear phased array receiver 100 combined at radio frequency (RF) having N elements, where N=4. The antennas (102-0 through 102-3) are spaced apart by a distance, d, and are situated along the z-axis. Using the spherical coordinate system, a signal arriving at the $n^{th}$ element in the array with an angle of incidence, θ, will experience a phase shift, $\psi_n$, of:

$$\psi_n = -nkd\cos(\theta) = -n\psi_o, \tag{1}$$

where k is the phase velocity, equal to $2\pi/\lambda$, with λ the wavelength. Phase shifters (104-0 through 104-3) in the receive elements add a compensating delay equal to $(N-n)\alpha$. Combining the outputs of all of the parallel receivers via combiner 106, the resultant signal in phasor notation is:

$$\begin{aligned} I &= \sum_{n=0}^{N-1} I_n e^{j[\psi_n-(N-n)\alpha]} \\ &= I_o e^{-jN\alpha} \sum_{n=0}^{N-1} e^{-jn[kd\cos(\theta)-\alpha]}. \end{aligned} \tag{2}$$

Currents are used in this equation, though other metrics could be used. It can be shown that the angle of maximum sensitivity, $\theta_{max}$, occurs at:

$$\begin{aligned} \theta_{max} &= \arccos\left(\frac{\alpha}{kd}\right)\Big|_{d=\lambda/2} \\ &= \arccos\left(\frac{\alpha}{\pi}\right)\Big|, \end{aligned} \tag{3}$$

which is where $kd\cos(\theta_{max})=\alpha$; hence, α is used to steer the beam. At $\theta_{max}$, the currents add in phase to a resultant value which is N times as large as each individual current. This results in an $N^2$ increase in the received power level.

Since there are now N receive elements generating uncorrelated noise, the total noise power is N times as large (variances add); hence, the received signal-to-noise ratio is increased by a factor of N. Another useful metric for phased arrays is the directivity, which is the ratio of the maximum radiated power to that from an isotropic radiator. This can also be shown to be N; thus, higher directivity requires more elements in the phased array.

From these equations, some basic system requirements can be derived. First, assume that the antennas are spaced a half-wavelength apart, making kd=π. Such a spacing eliminates the presence of grating lobes. For a four-element linear array example with θ=0, then $\psi_o=\pi$ and the incident phases at each receiving antenna are (0, −π, −2π, −3π). The required phase shifts in each phase shifter are then ($\alpha_{min}-3\pi$, $\alpha_{min}-2\pi$, $\alpha_{min}-\pi$, $\alpha_{min}$), where $\alpha_{min}$ is the minimum possible phase shift through the device. At θ=π/2, $\psi_o=0$ and the incident phases at the antennas are (0, 0, 0, 0). The required phase shifts through the phase shifters are all equal to $\alpha_{min}$. These two cases define the range of required phase shifts in each element, which is $\alpha_{min}$ to αmin−3π. More generally, for an N-element array, the phase shifter has to vary from $\alpha_{min}$ to $\alpha_{min}$−N−1)π. Such a large phase-shift range can be difficult to achieve.

A second system requirement comes from the insertion loss of the phase shifters. This amounts to a substitution of k=β−jα, where α is the loss per unit length, into equation (2), resulting in an exponentially decreasing term within the summation. For coherent signal addition, amplifiers must be inserted to equalize the varying signal amplitudes. Without these amplifiers, the directivity of the array will suffer.

The above example was for an RF-combined phased array. It is possible, though, to combine the signals at any point in the received signal path, such as at the intermediate frequency (IF), the baseband frequency, or even in the digital domain. Each has its own advantages and disadvantages. Comparing the two extremes—RF combining and digital combining—one finds that RF combining results in the lowest power consumption and required area. This comes with the penalty of having to generate very precise phase shifts and amplitude balance at high frequencies. On the other hand, digital combining (also known as digital beamforming) has the advantage of being able to generate very accurate phase shifts and amplitude balance, within the accuracy of the analog-to-digital converter (ADC). The key drawback of digital beamforming is the need for complete parallel receivers all feeding a single ADC. For very high data rates, this ADC can be quite complex. Hence, digital beamforming can be area and power intensive.

Another option for phased arrays is to combine at IF, after the mixer. It should be realized that the phase shift for the signals can then be realized in either the signal path or the local oscillator (LO) path. Multiple phases of the LO signal can be generated globally or locally, and these different phases can be used to provide the necessary phase shift to the array elements. This has the benefit of being able to match the amplitudes much better, since lossy phase shifters in the signal path are not needed. A drawback of this approach, though, is that the LO generation and distribution circuitry can consume sizeable power and/or area. Also, such an approach can suffer from mixer nonlinearity, where blocking signals located outside of the desired direction still make it to the mixer since they have not yet been cancelled at that point.

SUMMARY OF THE INVENTION

Principles of the invention provide improved phased array techniques and architectures.

For example, in one aspect of the invention, a linear phased array includes N discrete phase shifters and N−1 variable phase shifters, wherein the N−1 variable phase shifters are respectively coupled between adjacent output nodes of the N discrete phase shifters such that the N discrete phase shifters reduce an amount of continuous phase shift provided by the N−1 variable phase shifters. Each of the N discrete phase shifters may select between two or more discrete phase shifts. The N discrete phase shifters also preferably eliminate a need for a variable termination impedance in the linear phased array.

In another aspect of the invention, a method for use in a linear phased array includes the following steps. First, N discrete phase shifters and N−1 variable phase shifters are provided. The N−1 variable phase shifters are respectively coupled between adjacent output nodes of the N discrete phase shifters. Then, a phase shifting mode is selected from among multiple phase shifting modes associated with the N discrete phase shifter. Discrete phase shift settings associated with the N discrete phase shifters are configured in the modes such that, as the number of discrete phase shift settings increases, a variable phase shift range of the N−1 variable phase shifters decreases.

Advantageously, illustrative principles of the invention provide a phased array suitable for single-chip integration in silicon. This is accomplished by providing a widely adjustable phase shifter which has low insertion loss and low return loss. More particularly, illustrative principles of the invention provide a phase-shifting and combining architecture which reduces the required range of the phased shifter and minimizes insertion and return losses.

These and other objects, features and advantages of the present invention will become apparent from the following detailed description of illustrative embodiments thereof which is to be read in connection with the accompanying drawings.

DETAILED DESCRIPTION OF PREFERRED EMBODIMENTS

It is to be appreciated that while illustrative principles of the invention are described herein with regard to an N-element linear array for a receiver, the principles apply to transmitters as well.

Figure 1:
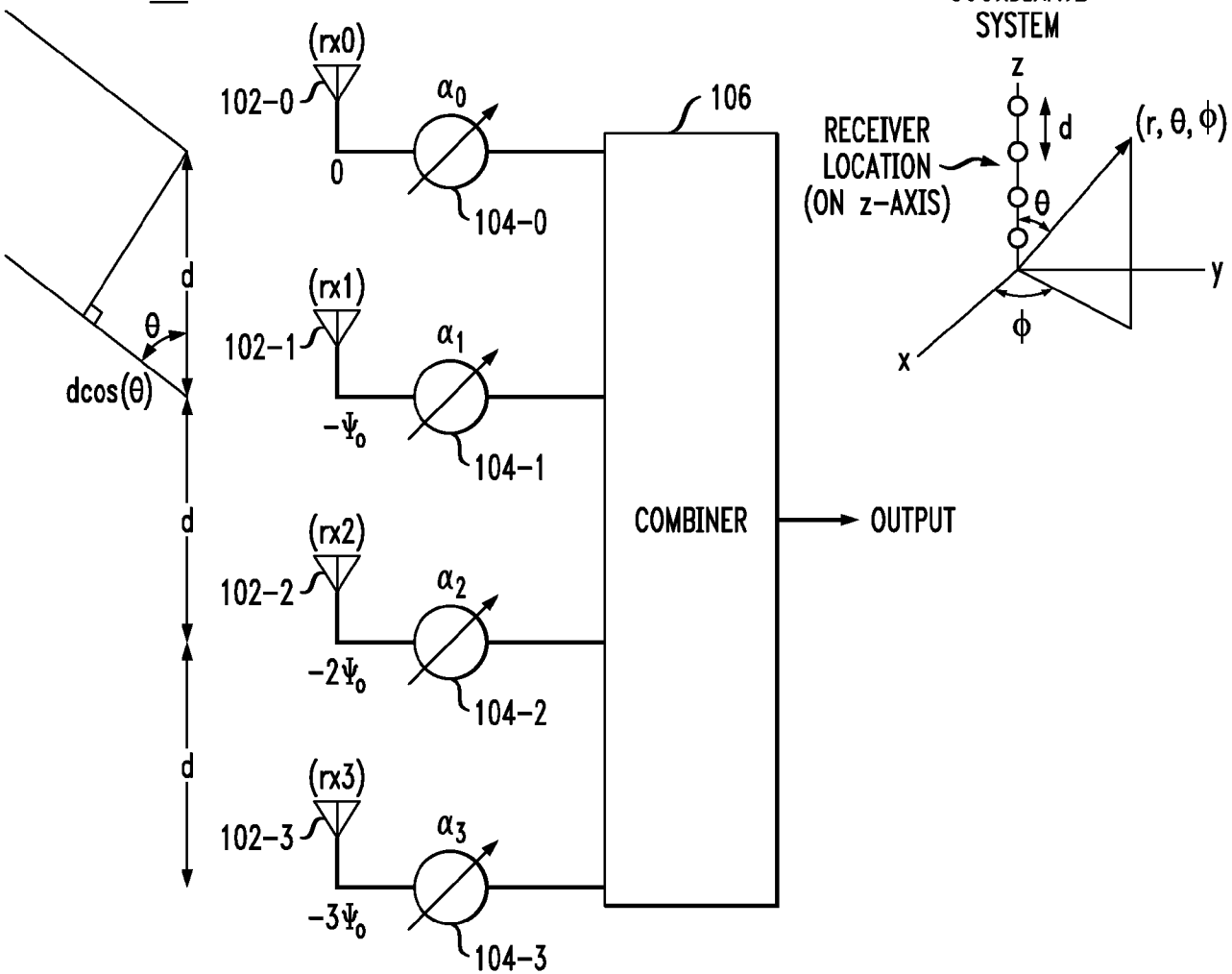
FIG. 1 PRIOR ART
FIG. 1 illustrates a conventional linear phased array.
Figure 2A:
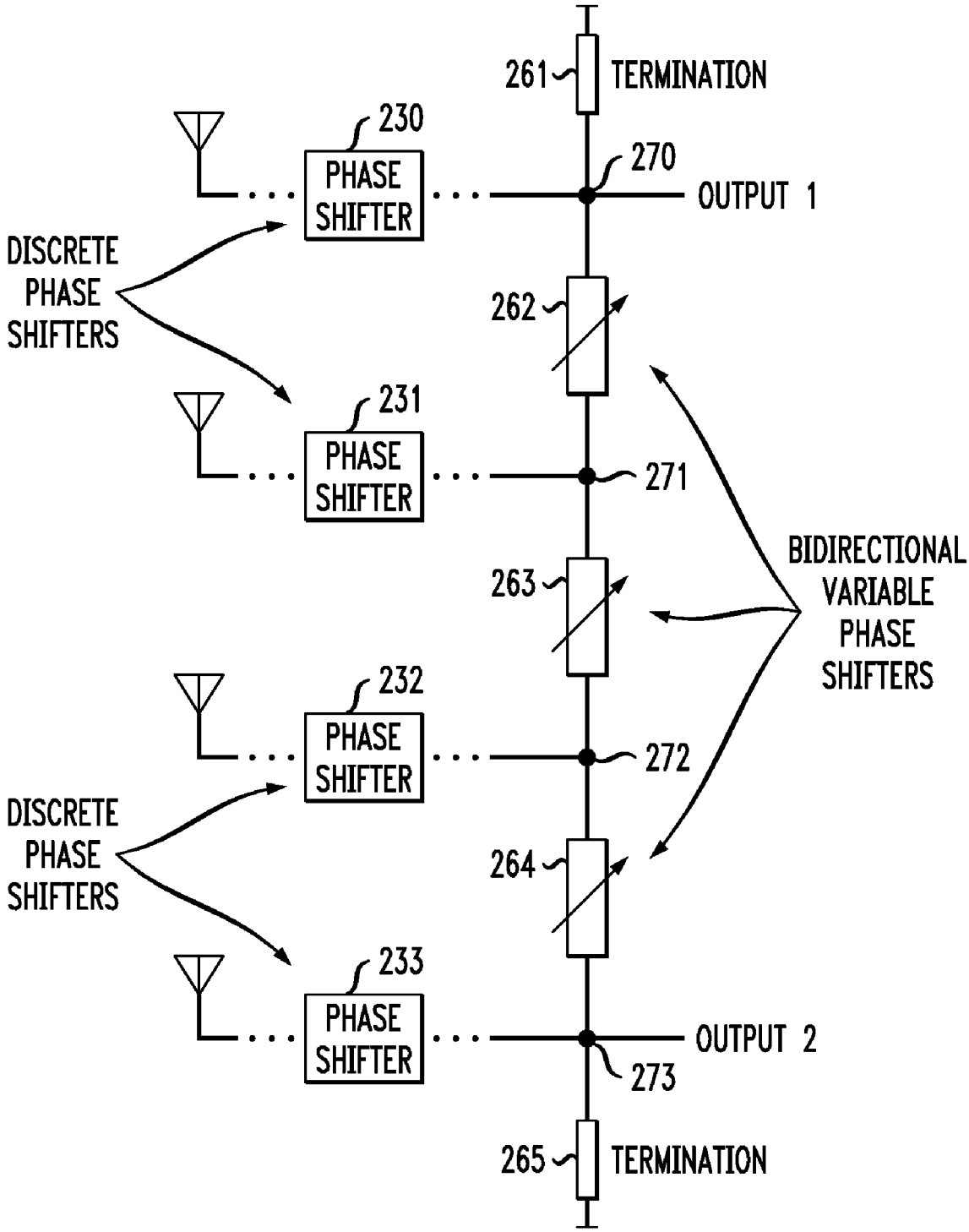
FIG. 2A illustrates a linear phased array, according to an embodiment of the invention.

FIG. 2A generally depicts one embodiment of a 4-element linear phased array, applicable to both receivers and transmitters. The main functional components of phased array architecture 200 include parallel discrete phase shifters 230, 231, 232 and 233, connected to nodes 270, 271, 272 and 273, respectively. Furthermore, the inventive architecture provides for inserting bidirectional variable phase shifters (VPS) 262, 263 and 264 between adjacent nodes 270 and 271; 271 and 272; and 272 and 273, respectively. Furthermore, termination impedances 261 and 265 are attached to nodes 270 and 273, respectively, and these nodes are the two outputs from the linear phased array. Note that while these nodes serve as outputs for a receiver implementation, it is to be understood that they may serve as inputs for a transmitter implementation since the variable phase shifters are bidirectional.

Illustrative principles of the invention provide for use of the discrete phase-shifting elements (230-233), as shown, to reduce the required continuous phase shift in the variable phase shifters. The discrete phase shifters may select between a phase shift of 0 and $\delta_n$. Such a modification not only reduces the required range of the VPS, but also can eliminate the need for a variable termination impedance, since as the phase-shift range of the VPS decreases, so too does the impedance variation. Further, one or more of the discrete phase shifters could include a 180° phase shift.

Given this general relationship between phase shifting elements formed according to principles of the invention, various illustrative embodiments are described below.

Figure 2B:
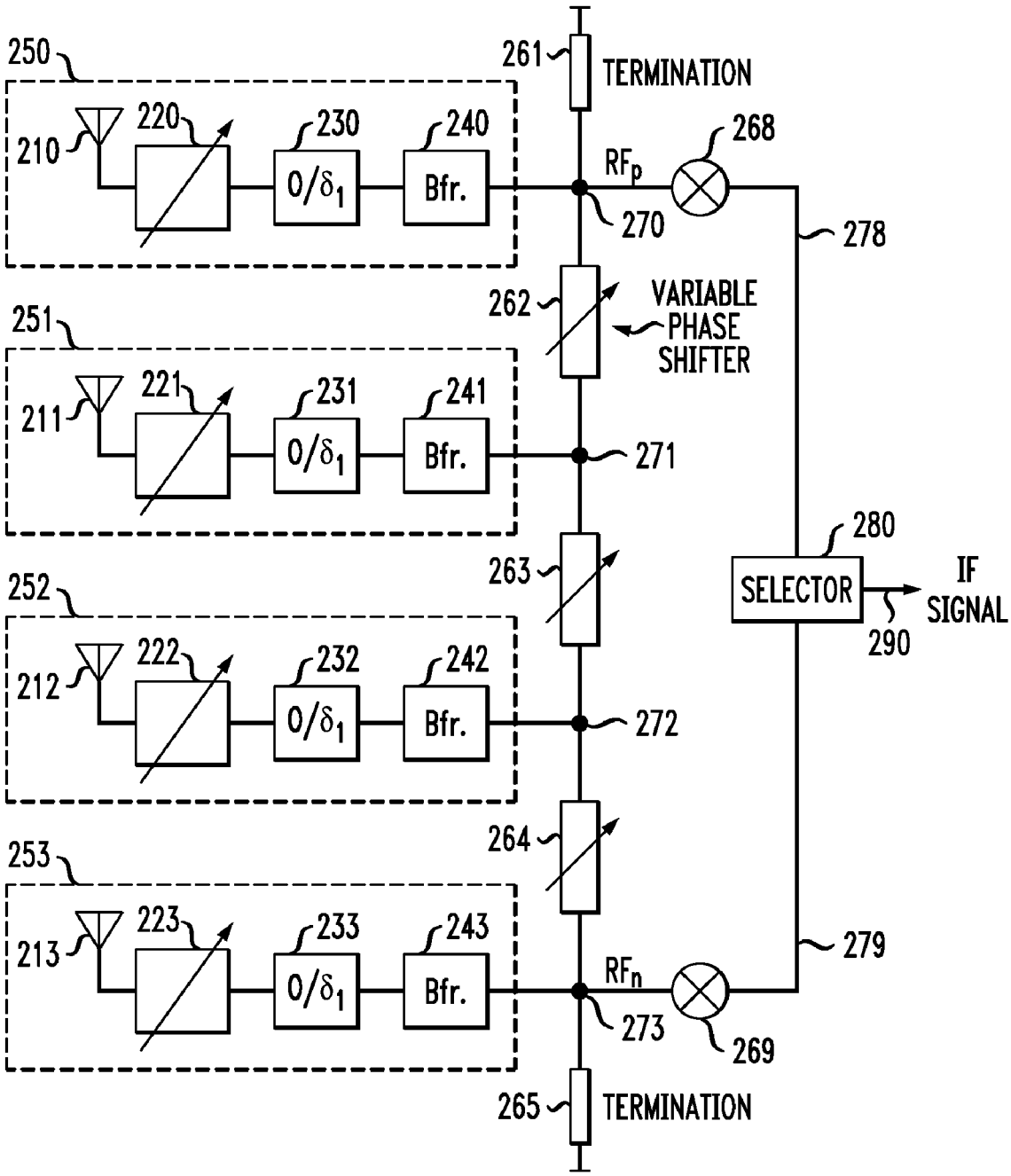
FIG. 2B illustrates a linear phased array followed by an intermediate frequency stage, according to an embodiment of the invention.

FIG. 2B illustrates an embodiment of a phased array which minimizes the amount of parallel hardware by combining at RF while limiting the requirements of the RF phase shifters. In this embodiment, the discrete phase shifting elements (230-233) are located in the RF front-ends. FIG. 2B further illustrates how the two output nodes of the phased array (i.e., 270 and 278) can be attached to mixers 268 and 269 respectively, and how the mixer intermediate-frequency (IF) signals (nodes 278 and 279) can be optionally selected using device 280, providing a single IF output at node 290 (IF input node in a transmitter implementation). It is to be understood that an N-element linear phased array can be obtained by scaling the number of RF elements and variable phase shifters appropriately.

As detailed in FIG. 2B, RF front-end 250 includes antenna 210, connected to RF amplifier 220, connected to discrete phase shifter 230, connected to a buffer 240. Likewise, front-ends 251, 252, and 253 include the same elements, numbered as 211, 221, 231 and 241 for 251; 212, 222, 232 and 242 for 252; and 213, 223, 233 and 243 for 253. For the receiver, the RF amplifier is a low-noise amplifier which reduces the overall noise figure of the receive array. For the transmitter, the RF amplifier is a power amplifier which increases the output transmitted power. These RF amplifiers require variable gain to compensate for loss in the phase-shift network.

As mentioned above, discrete phase-shifting elements 230-233 are inserted in each front-end to reduce the required continuous phase shift in the variable phase shifters 262-264. The discrete phase shifters select between a phase shift of 0 and $\delta_n$. An Again, this reduces the required range of the VPS, but also allows elimination of a variable termination impedance, since as the phase-shift range of the VPS decreases, so too does performance of the discrete phase shifter from the continuous phase shifter.

The bidirectional variable phase shifters (VPS) 262-264 couple signals between adjacent RF front-ends (250-253). This adjacent coupling allows the phase shift of one element to be reused by subsequent elements, which in turn reduces the total phase shift required in each phase shifter. That is, sharing the phase shift along multiple lines reduces the required range of the phase shifter. The required phase shift in these VPS devices depends on whether discrete phase shifters (230-233) are used in the RF front-ends. Depending on the realization of the VPS device, its characteristic impedance may depend on the phase shift. As a result, the termination impedances (261 and 265) may need to be variable to track the characteristic impedance of the VPS.

As will be shown, the RF outputs, 270 and 273, are directed at different incident angles. This provides for concurrent illumination of different incident angles. As an example, node 270 can be used for scanning one angle range for a RADAR, while node 273 can be used for scanning a different range of angles. If concurrent operation is not desired, then selector 280 can be used to multiplex these two outputs onto a single line.

For an input plane wave with an incident angle of $\theta$, the arrival phase of each signal in the array is uniformly decreasing by an amount of $\psi_o$, where $\psi_o$ is defined in equation (1). Discrete phase shifters (230-233) add an additional phase delay of $\delta_n$. There are two outputs from the array, labeled RFp and RFn and numbered 270 and 273. The resulting signals at output RFp is:

$$I_{RFP} = I_o \sum_{n=0}^{N-1} e^{j[-n\psi_o - \delta_n - n\alpha]} \tag{4}$$

For coherent signal addition, each element in the summation must be equal; hence for RFp:

$$\delta_o = \psi_o + \delta_1 + \alpha = 2\psi_o + \delta_2 + 2\alpha = \ldots = N\psi_o + \delta_N + N\alpha. \tag{5}$$

Solving for $\psi_o$ as a function of $\alpha$ and $\delta$ yields:

$$\psi_o = -\alpha - (\delta_{i+1} - \delta_i), \tag{6}$$

Equation (6) shows how the discrete phase shifters change the relationship between incident angle ($\psi_o$) and VPS angle ($\alpha$). The same procedure can be followed for the other output, RFn, to yield the following relationships:

$$I_{RFN} = I_o \sum_{n=0}^{N-1} e^{j[-n\psi_o - \delta_n - (N-1-n)\alpha]}, \tag{7}$$

$$\begin{aligned} \delta_o + (N-1)\alpha &= \psi_o + \delta_1 + (N-2)\alpha = \ldots \\ &= (N-2)\psi_o + \delta_{N-2} + \alpha \\ &= (N-1)\psi_o + \delta_{N-1}, \end{aligned} \tag{8}$$

$$\psi_o = \alpha - (\delta_{i+1} - \delta_i). \tag{9}$$

These relationships can be used to derive relationships between $\psi_o$ and $\alpha$ for various values of $\delta_n$. Note that $\psi_o$ will vary from $-\pi$ to $\pi$ for $\lambda/2$ antenna spacing. It is necessary to then calculate the range of $\alpha$ needed to cover this range of $\psi_o$.

Figure 3:
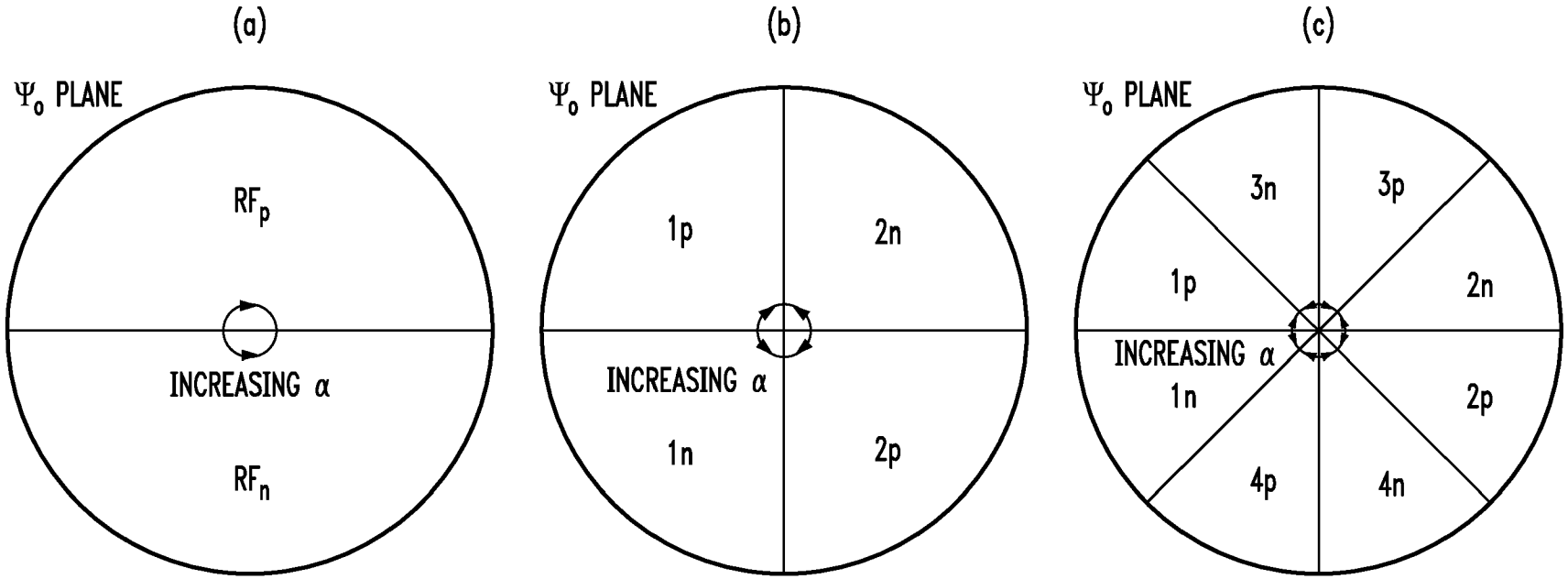
FIGS. 3(*a*) through 3(*c*) illustrate respective phase shift allocations across tuning ranges, according to embodiments of the invention.

First, let us examine the case where there are no discrete phase shifters; hence, $\delta_n=0$ for all n. This is considered to be "embodiment A" of the invention. With $\delta_n=0$ for all n, equation (6) shows that the RFp output can be used to illuminate angles corresponding to $\psi_o=-\alpha$, while equation (7) shows that the RFn output can be used to illuminate angles corresponding to $\psi_o=\alpha$. For a varying from $\pi$ to $2\pi$, the phased array can continuously cover all values of to $\psi_o$. The resulting allocation of $\psi_o$ between outputs RFp and RFn is depicted in FIG. 3(*a*) and summarized in Table 1. Equation (3) is then used to translate $\psi_o$ values to $\theta_{max}$ values. In summary, embodiment A does not require a discrete phase shifter. However, a VPS with a 180° tuning range is needed. Note that having two outputs allows the range of input angles to be spread between the two outputs; hence, to cover a $2\pi$ range in $\psi_o$ only requires a $\pi$ range in $\alpha$.

TABLE 1

Relationship between discrete phase shifts and range of incident phase shifts for Embodiment A, where $\alpha = \pi$ to $2\pi$

| Mode | $\delta_0$ | $\delta_1$ | $\delta_2$ | $\delta_3$ | $\psi_o$ range, RFp | $\psi_o$ range, RFn |
|---|---|---|---|---|---|---|
| — | 0 | 0 | 0 | 0 | $\psi_o = -\alpha =$ $(-\pi:-2\pi)$ | $\psi_o = \alpha =$ $(\pi:2\pi)$ |

Achieving a 180° tuning range for the variable phase shifter is still challenging using standard silicon-based devices, such as transmission lines loaded with voltage-dependent capacitors (varactors). To halve the range of cc, the discrete phase shifters are required, operating in one of two modes. The first mode is for zero relative phase shift between all discrete phase shifters. This is the case just described above, where $\psi_o=-\alpha$ for output RFp, and $\psi_o=+\alpha$ for output RFn, except now $\alpha$ is varying from $\pi$ to $3\pi/2$. The second mode is for $\delta_{i+1}-\delta_i=\pi$; hence $\delta_0=0$, $\delta_1=\pi$, $\delta_2=0$, $\delta_3=\pi$. Substituting this into equations (6) and (9) results in Table 2. The results are also depicted in FIG. 3(*b*). This case is considered to be "embodiment B" of the invention, where a discrete phase shifter is needed which switches between 0 and 180° phase shifts. Additionally, a VPS with a 90° tuning range is required. Here, to cover a $2\pi$ range in $\psi_o$ only requires a $\pi/2$ range in $\alpha$ since both two outputs and two modes are used.

TABLE 2

Relationship between discrete phase shifts and range of incident phase shifts for Embodiment B, where $\alpha = \pi$ to $3\pi/2$

| Mode | $\delta_0$ | $\delta_1$ | $\delta_2$ | $\delta_3$ | $\psi_o$ range, RFp | $\psi_o$ range, RFn |
|---|---|---|---|---|---|---|
| 1 | 0 | 0 | 0 | 0 | $\psi_o = -\alpha =$ $(-\pi:-3\pi/2)$ | $\psi_o = \alpha =$ $(\pi:3\pi/2)$ |
| 2 | 0 | $\pi$ | $2\pi \rightarrow 0$ | $3\pi \rightarrow \pi$ | $\psi_o = -\alpha - \pi =$ $(0:-\pi/2)$ | $\psi_o = \alpha - \pi =$ $(0:\pi/2)$ |

To further reduce the required range in $\alpha$, yet two more modes can be introduced. A reduced range in cc is advantageous for controlling the range of characteristic impedance variation in the VPS as its phase shift is varied. For both embodiments "A" and "B," the impedance of the VPS varies considerably over the phase-shift range, necessitating a variable termination impedance at both terminals of the phased array. Targeting a range in $\alpha$ of $\pi$ to $5\pi/4$, we first retain modes 1 and 2 from embodiment B. The other two modes are for $\delta_{i+1}-\delta_i=\pm\pi/2$. To reduce the number of steps in the discrete phase shifter, modes 3 and 4 are made to overlap as much as possible with modes 1 and 2. The results are summarized in Table 3 and depicted in FIG. 3(*c*). This case is considered to be "embodiment C" of the invention, where discrete phase shifters are needed to provide 0/90, 0/180, 0/270, and 0/180° phase shifts. Additionally, a VPS with a 45° tuning range is required. Here, to cover a $2\pi$ range in $\psi_o$ only requires a $\pi/4$ range in $\alpha$.

TABLE 3

Relationship between discrete phase shifts and range of incident phase shifts for Embodiment C, where $\alpha = \pi$ to $5\pi/4$

| Mode | $\delta_0$ | $\delta_1$ | $\delta_2$ | $\delta_3$ | $\psi_o$ range, RFp | $\psi_o$ range, RFn |
|---|---|---|---|---|---|---|
| 1 | 0 | 0 | 0 | 0 | $\psi_o = -\alpha =$ $(-\pi:-5\pi/4)$ | $\psi_o = \alpha =$ $(\pi:5\pi/4)$ |
| 2 | 0 | $\pi$ | $2\pi \rightarrow 0$ | $3\pi \rightarrow \pi$ | $\psi_o = -\alpha - \pi =$ $(0:-\pi/4)$ | $\psi_o = \alpha - \pi =$ $(0:\pi/4)$ |
| 3 | $\pi/2$ | $\pi$ | $3\pi/2$ | $2\pi \rightarrow 0$ | $\psi_o = -\alpha - \pi/2 =$ $(\pi/2:\pi/4)$ | $\psi_o = \alpha - \pi/2 =$ $(\pi/2:3\pi/4)$ |
| 4 | $5\pi/2 \rightarrow \pi/2$ | $2\pi \rightarrow 0$ | $3\pi/2$ | $\pi$ | $\psi_o = -\alpha + \pi/2 =$ $(-\pi/2:-3\pi/4)$ | $\psi_o = \alpha + \pi/2 =$ $(-\pi/2:-\pi/4)$ |

All three embodiments (A, B and C) are able to scan over a $\psi_o$ range of $-\pi$ to $+\pi$, corresponding to a $\theta$ range of $\pi$ to 0. The continuous tuning range of the variable phase shifter will dictate whether discrete phase shifters are required in the front ends.

Figure 4:
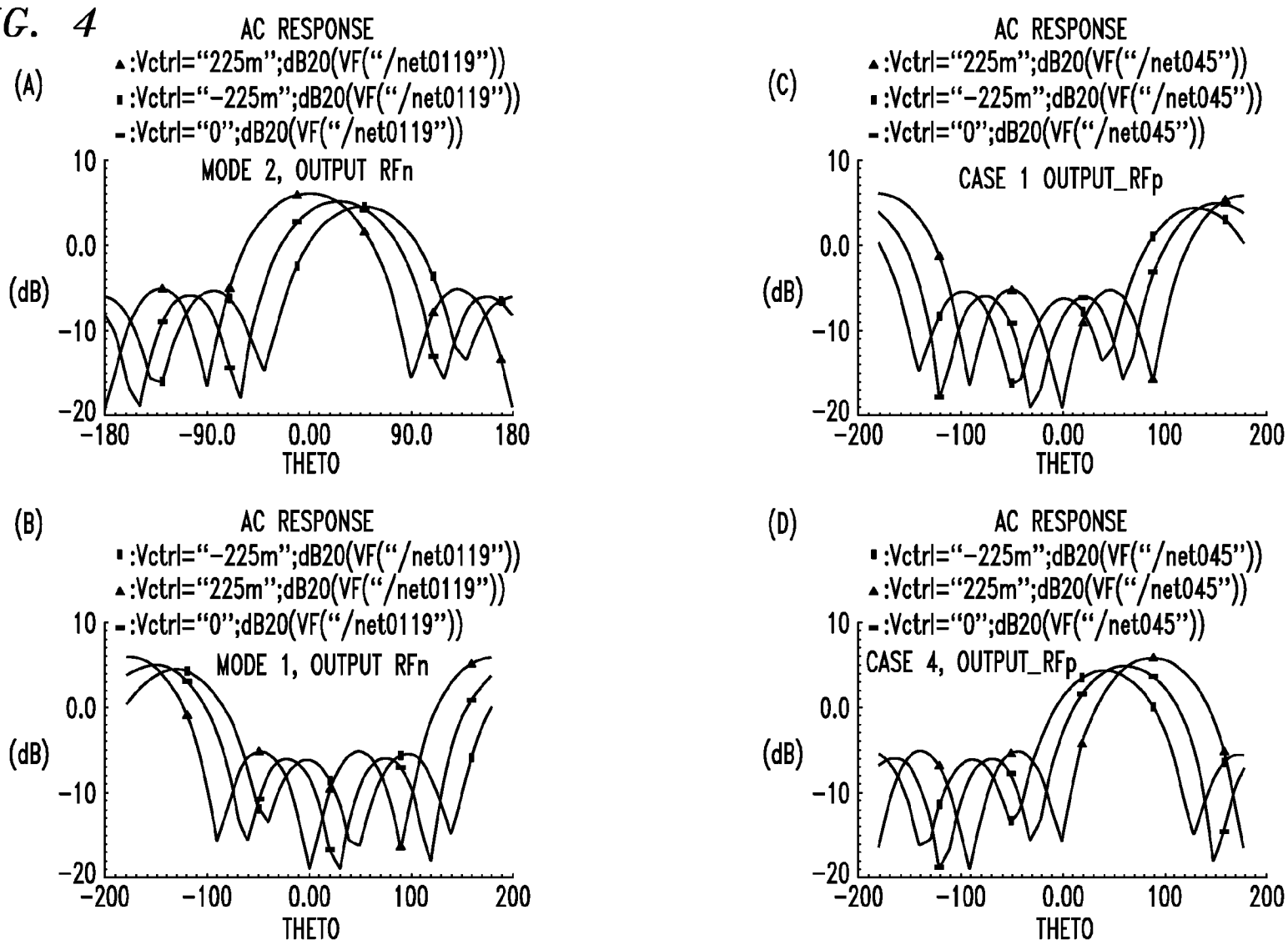
FIG. 4 illustrates simulated array gain for three different modes, according to an embodiment of the invention.
Figure 5:
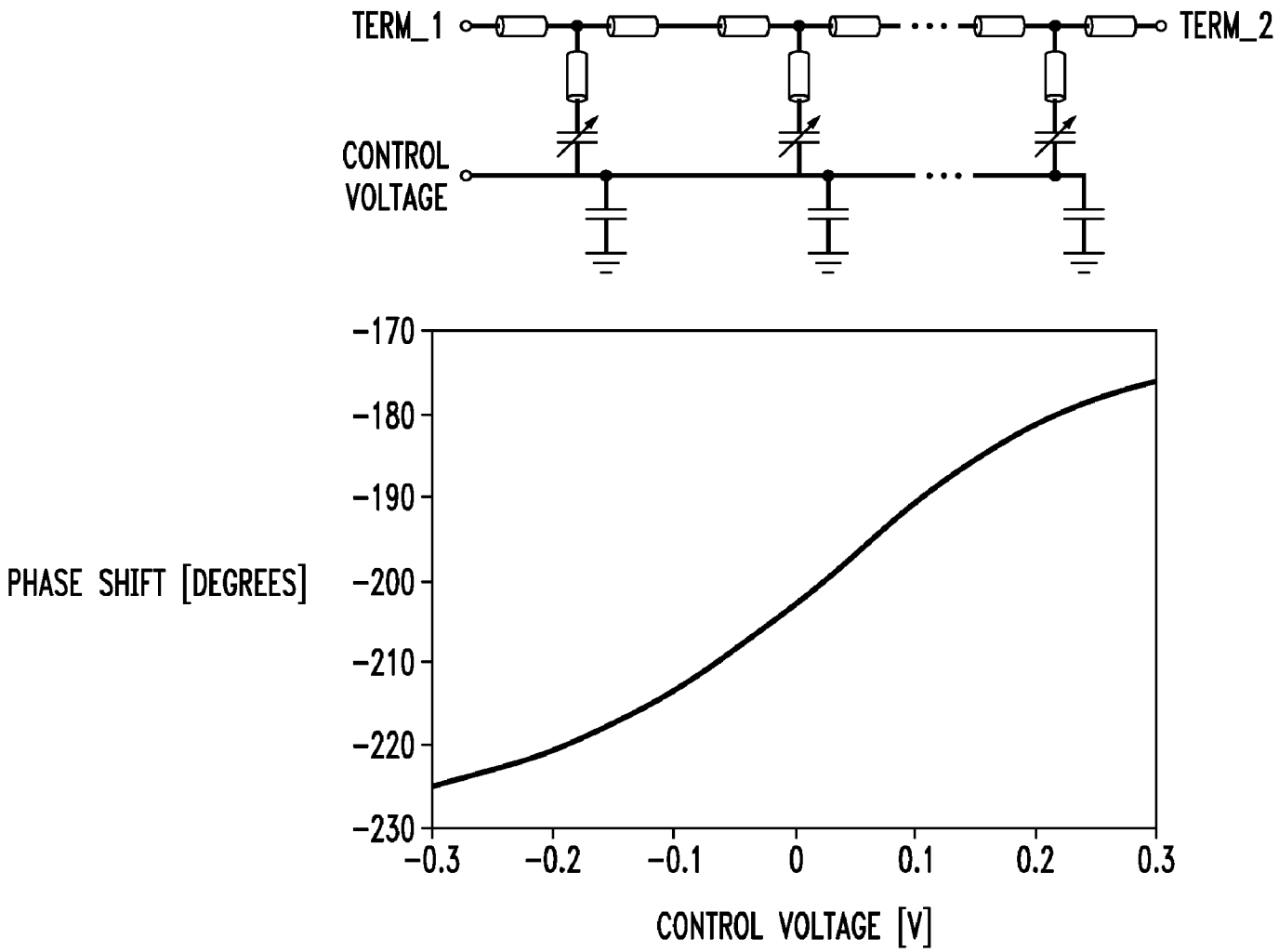
FIG. 5 illustrates simulated phase shift of a bidirectional variable phase shifter, according to an embodiment of the invention.

A few simulated examples are now presented to demonstrate "proof-of-concept." An example of the simulated performance of embodiment "C" is shown in FIG. 4, for modes 1, 2, and 4. This plot shows the gain of the phased array as a function of $\psi$ varying continuously from $-\pi$ to $\pi$. A family of three curves are plotted, for three different values of $\alpha$. As can be seen, the array gain varies as a function of $\alpha$, since the insertion loss of the VPS is dependent on the phase delay. This underscores the need for variable-gain amplifiers in the RF front end. An example of the VPS phase shift is shown in FIG. 5 as a function of control voltage. This phase shifting line is formed using transmission line periodically-loaded with voltage-dependent capacitors. FIG. 5 demonstrates that a continuous variable phase shifter can be implemented with a phase-shift range greater than $-\pi$ to $-5\pi/4$. The insertion loss varies between −0.8 and −2 dB, while the return loss is better than 20 dB for all settings. This VPS was designed for use in embodiment "C."

Alternately, if a continuous scanning range is not required, then simply the discrete phase shifters can be used, where the VPS is locked to a single setting. In embodiment "C," this provides for a three-direction antenna switch. For example, in embodiment "C," the VPS can be set at $\alpha=\pi$. From Table 3, we see that both RFp and RFn outputs are directed at $\pi/2$, 0, and $-\pi/2$, for modes 3, 2, and 4, respectively, when $\alpha=\pi$. For $d=\lambda/2$, this corresponds to $\theta$=60°, 90°, 120°. Since both the RFp and RFn outputs are pointed at the same direction, the outputs can be summed rather than multiplexed. This architecture can therefore be used to switch between three different angles, which can be useful for line-of-sight communications when that line-of-sight gets blocked.

Figure 2C:
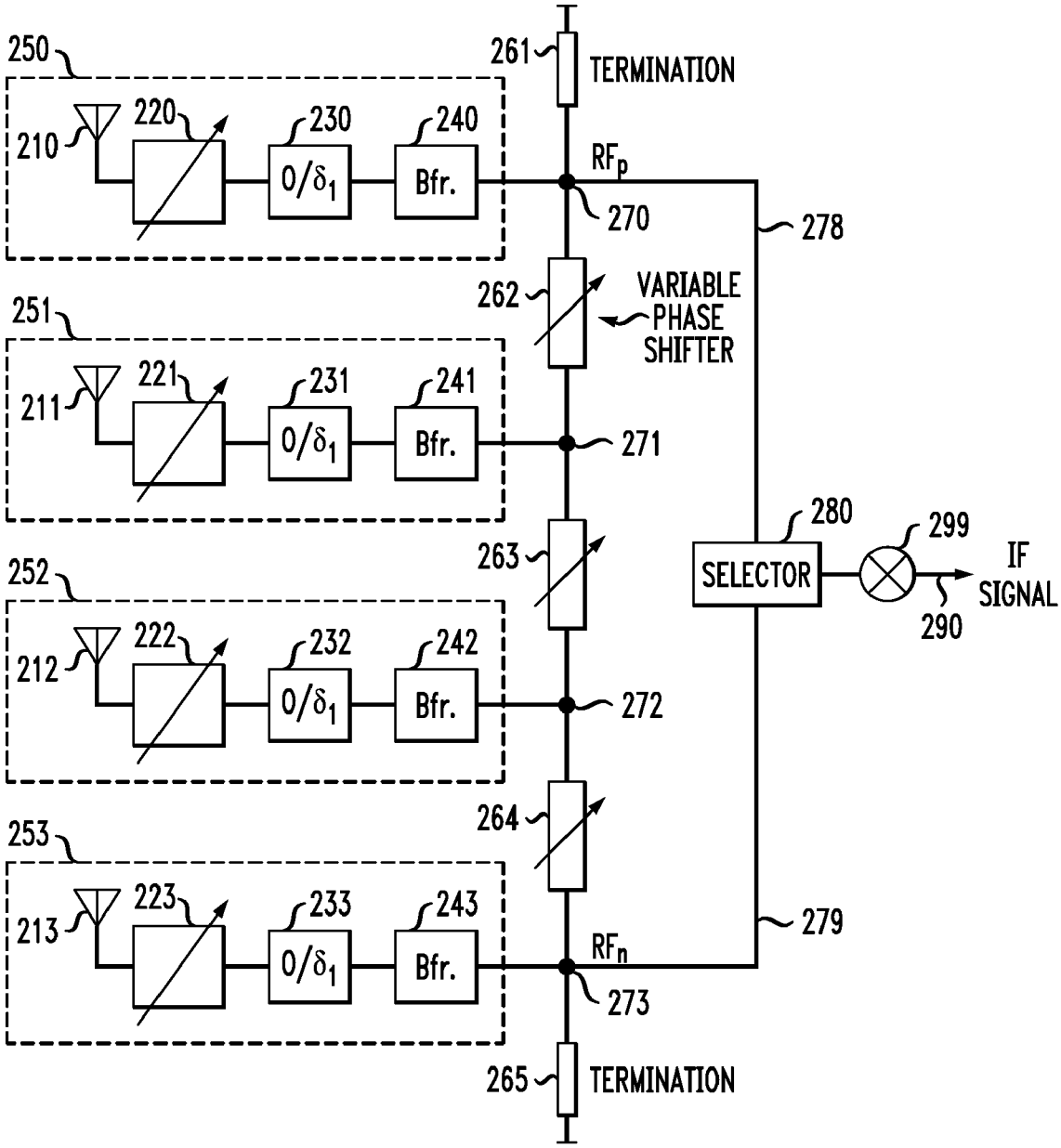
FIG. 2C illustrates a linear phased array followed by an intermediate frequency stage, according to another embodiment of the invention.
Figure 2D:
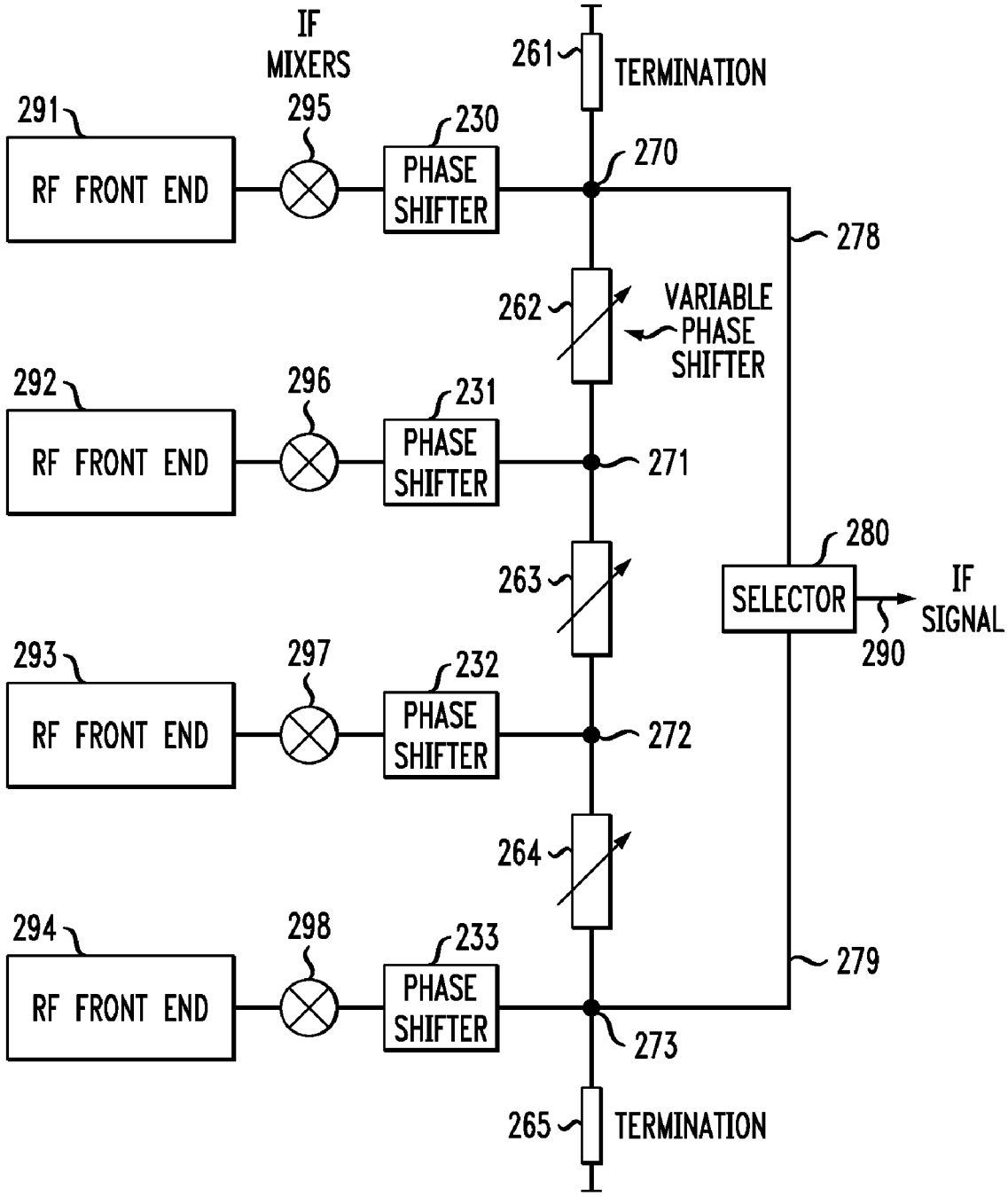
FIG. 2D illustrates a linear phased array occurring at an intermediate frequency stage, according to an embodiment of the invention.

Turning now to FIGS. 2C and 2D, alternative embodiments are illustrated showing variations on the linear phased array architecture of FIG. 2A.

For example, FIG. 2C shows a similar arrangement as the embodiment of FIG. 2B, however, here the selector 280 occurs before IF mixer 299. That is, selection of the output 278 or output 279 of the linear phased array is made at RE. Then, the selected output is converted to IF resulting in IF signal 290.

FIG. 2D illustrates an embodiment where the linear phased array is where implemented at a frequency lower than RF, i.e., at IF. That is, FIG. 2D shows N RF front-ends (291-294) and N IF mixers (295-298), followed by the discrete parallel phase shifters (230-233) and the bidirectional continuous phase shifters (262-264). All the phase shifters occur at the intermediate frequency.

It is to be understood that, given the inventive principles described in detail herein, those skilled in the art will realize other variations to the illustrative embodiments.

Furthermore, it is to be appreciated that, as with other phased arrays, the architectures described herein can be used as simple diversity switches for receivers or transmitters. Hence, the complete architectures provide for continuous scanning, discrete scanning, and a diversity switch.

Advantageously, illustrative principles of the invention provide methods and apparatus for providing phase shifting and signal combining for a phased-array wireless receiver or transmitter. Illustrative principles of the invention make use of bidirectional variable phase shifters coupled between adjacent radio-frequency front-end elements (e.g., antennas and amplifiers). These phase shifters are adjusted to provide a continuous phase shift over a certain range, such that signals combine coherently at the terminals of the array. Coupling between adjacent front-end elements allows the phase shift of one device to be "reused" by adjacent phase-shifting devices, thereby limiting the total phase shift required in each device. This structure also has the added benefit of providing two or more simultaneous outputs, each of which is directed at different incident angles. This allows the array to simultaneously illuminate two or more different directions. Furthermore, to overcome the potential limited tuning range and/or excessive insertion loss of the variable phase shifters, discrete phase shifters are introduced into each path. The overall architecture is well-suited for integration of a linear phased array onto a single semiconductor chip, with particular application to millimeter-wave frequencies.

Although illustrative embodiments of the present invention have been described herein with reference to the accompanying drawings, it is to be understood that the invention is not limited to those precise embodiments, and that various other changes and modifications may be made by one skilled in the art without departing from the scope or spirit of the invention.

What is claimed is:

1. A linear phased array, comprising:

N discrete phase shifters; and

N−1 variable phase shifters, wherein the N−1 variable phase shifters are respectively coupled between adjacent output nodes of the N discrete phase shifters such that the N discrete phase shifters reduce an amount of continuous phase shift provided by the N−1 variable phase shifters.

2. The linear phased array of claim 1, wherein each of the N discrete phase shifters select between two or more discrete phase shifts.

3. The linear phased array of claim 1 wherein the N discrete phase shifters eliminate a need for a variable termination impedance in the linear phased array.

4. The linear phased array of claim 1, wherein the N discrete phase shifters and the N−1 variable phase shifters operate at radio frequency (RF).

5. The linear phased array of claim 4, wherein two output nodes of the linear phased array are respectively coupled to two intermediate frequency (IF) mixers.

6. The linear phased array of claim 5, wherein a selector is coupled to the two IF mixers.

7. The linear phased array of claim 4, wherein two output nodes of the linear phased array are coupled to a selector.

8. The linear phased array of claim 7, wherein an output node of the selector is coupled to an intermediate frequency (IF) mixer.

9. The linear phased array of claim 1, wherein the N discrete phase shifters and the N−1 variable phase shifters operate at intermediate frequency (IF).

10. The linear phased array of claim 9, wherein N input nodes of the linear phased array are coupled to N IF mixers, which are coupled to N RF front-end elements.

11. The linear phased array of claim 1, wherein the N−1 variable phase shifters are bidirectional.

12. The linear phased array of claim 1, wherein the N−1 variable phase shifters are adjustable so as to provide a continuous phase shift over a given range such that signals presented thereto combine coherently at one or more nodes of the phased array.

13. The linear phased array of claim 1, wherein output nodes of the linear phased array are directed at different incident angles.

14. The linear phased array of claim 1, wherein the linear phased array comprises two or more outputs.

15. The linear phased array of claim 14, wherein the two or more outputs are connectable along any outputs of the N−1 variable phase shifters such that two or more simultaneous outputs are directed at different incident angles.

16. The linear phased array of claim 15, wherein the two or more outputs reduce phase shift variation requirements of the N−1 variable phase shifter.

17. The linear phased array of claim 1, wherein phase shift settings of the N discrete phase shifters are configured in modes such that angles of incidence are divided into multiple sections.

18. The linear phased array of claim 17, wherein as the number of discrete phase shift settings increases, a variable phase shift range of the N−1 variable phase shifters decreases.

* * * * *